United States Patent [19]

Gibbons

[11] 4,387,701

[45] Jun. 14, 1983

[54] FLUID FRICTION FURNACE

[76] Inventor: Edwin E. Gibbons, R.D. #3, Beech St., Newton Falls, Ohio 44444

[21] Appl. No.: 120,365

[22] Filed: Feb. 11, 1980

[51] Int. Cl.[3] ..... F24C 5/00

[52] U.S. Cl. ..... 126/247; 237/12.1; 126/26

[58] Field of Search ..... 126/247, 83, 26; 122/26; 237/12.1

[56] References Cited

U.S. PATENT DOCUMENTS

| | | | |
|---|---|---|---|
| 1,126,354 | 1/1915 | Becker | 122/26 |
| 3,164,147 | 1/1965 | Love et al. | 126/247 |
| 4,256,085 | 3/1981 | Line | 126/247 |
| 4,285,329 | 8/1981 | Moline | 126/247 |
| 4,325,354 | 4/1982 | Fuchs | 126/247 |

*Primary Examiner*—Larry Jones

*Attorney, Agent, or Firm*—Oldham, Oldham, Hudak & Weber Co.

[57] ABSTRACT

A fluid friction furnace is provided having a water jacket surrounding an enclosure partially filled with a heat transfer fluid. A plurality of rotating discs sandwiched between a plurality of stationary plates are rotated inducing the heat transfer oil into grooves in the surface of the rotating discs and circulating the oil between the rotating discs and stationary plates. Continuing pressure is applied between the rotating discs and stationary plates to generate calibrated fluid pressures in the circulation of the heated transfer fluid. By virtue of this forced friction circulation, the heat transfer fluid heats the enclosure and the water jacket surrounding the same. Circulation of the water in the water jacket throughout conventional systems provides distribution of the heat.

10 Claims, 3 Drawing Figures

FLUID FRICTION FURNACE

BACKGROUND OF THE INVENTION

Heretofore, the need for a generation of heat from a central source has relied upon fossil fuels such as coal, natural gas, heating oil, firewood, and the like. In locations where it is economically unsatisfactory to utilize a fossil fuel furnace, electricity has frequently been employed to heat a circulating fluid for distribution throughout the space to be heated. However, the use of electricity has typically been an expensive method of heating, for immersion of electrical circuitry within the circulating fluid has required substantial amperage for sufficient British Thermal Unit (BTU) production of energy. Therefore, a very real need in these times beset by energy shortages and lack of viable heating alternatives is a method for generating heat and the apparatus associated therewith which achieves greater efficiency than the conventional electric furnaces but does not require more expensive or scarce alternative energy sources.

OBJECTS OF THE INVENTION

Therefore, it is an object of the invention to provide an apparatus for the generation of heat utilizing the combination of a system of stationary plates, rotating discs, and heating fluid which is heated by forced passage between the rotating discs and the stationary plates.

Another object of the invention is to provide an apparatus for the generation of heat, as above, wherein continuing compression of the stationary plate and the rotating plate is utilized after initial free rotation to control the heating of the fluid as it is induced into the rotating plates and forced past the stationary plates.

Still another object of the invention is to provide an apparatus for the generation of heat, as above, wherein the rotating discs have oil induction grooves in their radial surfaces to induce the fluid into the area between the rotating disc and the stationary plate for the frictional heating process.

Another object of the invention is to provide a process for the production of heat comprising a tensional compression of rotating discs and stationary plates, a rotation of the rotating discs, and induction of the fluid between the plates and the frictional forcing of the fluid from the plates to generate heat.

Still another object of the invention is to provide a method for the production of heat which utilizes the energy of rotation of rotating plates and the heat transfer characteristics of fluid subject to frictional passage between rotating plates and stationary plates.

These and other objects of the invention will become more apparent as the detailed description of the preferred embodiments proceeds. However, it may be stated that these objects are achieved by: an apparatus for the generation of heat, comprising: (a) an enclosed container assembly having side walls; (b) a rotatable shaft mounted through said side walls of said container assembly; (c) an upper stationary shaft and a lower stationary shaft extending within said container assembly between two said side walls; (d) a plurality of stationary plates having a recess about said rotatable shaft and slidably engaged to both said stationary shafts; (e) a plurality of rotating discs having radial surfaces and interspaced in proximity to said stationary plates, each said rotating disc slidably engaged to and rotatable with said rotatable shaft and having a plurality of fluid induction grooves on said radial surfaces; (f) pressure means for placing said stationary plates near to said rotating discs, both said stationary shafts having tension means for restraining said slidable engagement of said stationary plates on both said stationary shafts; and (g) a volume of heat transfer fluid in communication with the lower extremities of said stationary plates and said rotating discs and inducible into said fluid induction grooves of said rotating discs and from said grooves in frictional, pressured communication between said discs and said plates.

The objects of the invention are also achieved by: a method for the production of heat, comprising: (a) tensionally placing a plurality of rotating discs near to a plurality of stationary plates interspaced therewith, each said rotating disc having radial surfaces and slidably secured to a rotating shaft rotatably secured to an enclosed container, and each said rotating disc having a plurality of fluid induction grooves on said radial surfaces; (b) rotating said rotating shaft and all said rotating discs in a pool of heat transfer fluid in said enclosed container; (c) inducing said heat transfer fluid into said fluid induction grooves in said rotating discs tensionally in proximity with said stationary plates; (d) forcing said fluid from between said rotating discs and said stationary plates along said radial surfaces in a pressured, frictional manner during said rotation of said rotating discs; and (e) transferring the heat from said heat transfer fluid to said container.

DESCRIPTION OF THE DRAWINGS

For an understanding of the scope of the invention, reference is had to the following drawings, wherein.

DETAILED DESCRIPTION OF THE PREFERRED EMBODIMENTS

Figure 1:
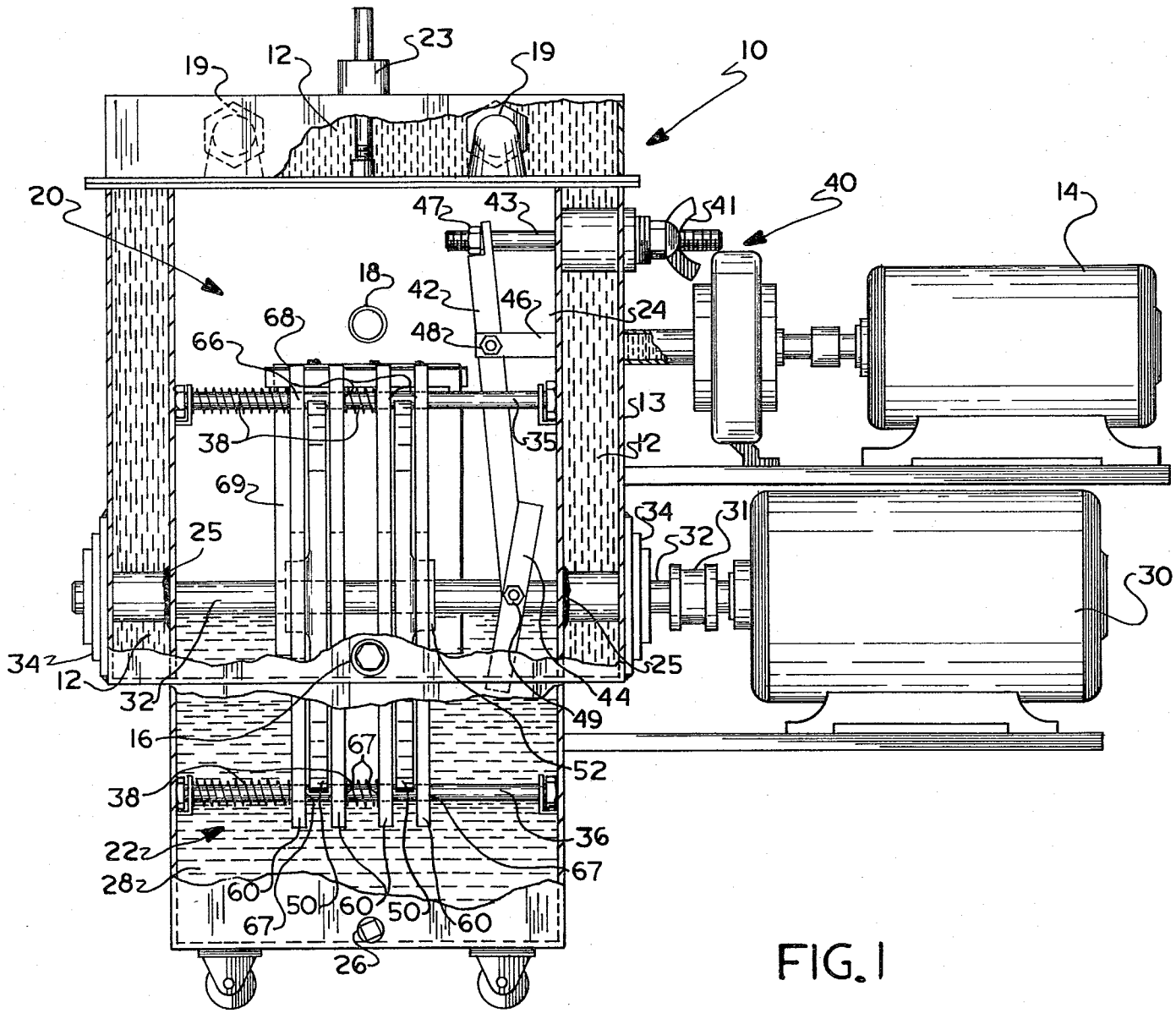
FIG. 1 is a partial cross-sectional view of the fluid friction furnace demonstrating the apparatus for generation of heat in the water jacket for circulation of the heat to other locations.

For a complete understanding of the scope of the invention, reference is had to FIG. 1, wherein fluid friction furnace 10 is described. The furnace 10 is composed of an outer wall 13 which encloses a distributing fluid jacket 12. The distributing fluid may be any heat transfer fluid known to those skilled in the art, but typically water is economical and physically and chemically stable. Air saturated with water vapor is another typical distributing fluid. The distributing fluid is circulated by means of distributing fluid circulation pump 14. The distributing fluid volume is regulated by an outlet 16 connected to a fluid supply system (not shown) which maintains the closed system of the distributing fluid circulation process through inlet pipe 18 and outlet pipes 19.

Within the distributing fluid jacket 12 is the fluid friction assembly, generally disclosed as 20. This assembly 20 is comprised of a heat chamber 22 having a multiplicity of said walls in polygonal shapes. Typically, the side wall may be cylindrical or comprise a number of surfaces joined at angles to create a polyhedral enclosure 22. Optionally, fins attached to heat chamber 22 may extend into distributing fluid jacket for increased heat transfer efficiency without departing from the scope of the invention. Extending from the enclosure 22 is a pressure relief pipe 23 to minimize the generation of pressure of fluid 28 within the enclosure 22. This relief pipe 23 is vented to outside environments to prevent unsafe environmental conditions.

Within side walls 24 are a plurality of side wall seals 25 which permit the securement of apparatus within the enclosure 22 to side walls 24 without mixture of distributing fluid jacket 12 with the materials inside enclosure 22.

Retained in the lower portion of enclosure 22 is a volume of heating fluid 28 as fed by heating fluid feed outlet 26 and connected to heating fluid supplies (not shown). The heating fluid may be any nontoxic heat transfer fluid known to those skilled in the art for the purpose of safely generating heat by frictional contact of the fluid with apparatus in a mechanical manner. Typically, the heating fluid is a standard heat transfer fluid or oil known to those skilled in the art, and it has been found that Eldoran heat transfer oil, a proprietary material produced by The Standard Oil Company of Ohio, and citgo heat transfer oil, a proprietary material produced by Citgo have been suitable for the purposes required by this invention. Further, a commercial grade permanent type antifreeze meets acceptable heat transfer standards.

The fluid 28 to be heated must be circulated within heat chamber 22. This is accomplished by heating fluid circulation means 30, typically being an external energy generator utilizing existing energy systems known to those skilled in the art. Typically, the circulation means 30 may utilize a reciprocating motor having from about two horsepower to about five horsepower and powered by fossil fuels or electricity generated from fossil fuels. In the system disclosed as the preferred embodiment, it has been found that a three horsepower electric motor capable of 1725 rpm at a voltage from 110 to 120 volts and at an amperage of 16 amperes well serves the purposes for circulating the fluid to be heated.

As is customary to those skilled in the art, the circulating means 30 employs a power coupling 31 which is connected with shaft 32 which extends through side wall seals 25 into the enclosure 22. For proper rotation of shaft 32, bearings 34 are provided on both side walls 24 adjacent to side walls seals 25. Shaft 32 forms the axis by which certain apparatus induces circulation of fluid 28 and the resultant heating by friction. Shaft 32 has a keyway recess 33 extending the length of shaft 32 which, along with key 37, secure certain portions of the apparatus for rotation therewith.

Secured to said side walls 24 are two stationary shafts which may be hex head bolts, cylinders, or other rod-shaped materials extending across said enclosure 22 above and below the rotatable shaft 32. The upper stationary shaft 35 provides securement for other segments of the apparatus generating heat, and the lower stationary shaft 36 provides a similar purpose below the rotatable shaft 32. Residing about upper stationary shaft 35 and lower stationary shaft 36 are a variety of spring tension means 38 known to those skilled in the art for restraining the position of apparatus slidably engaged to a cylindrical object.

Figure 2:
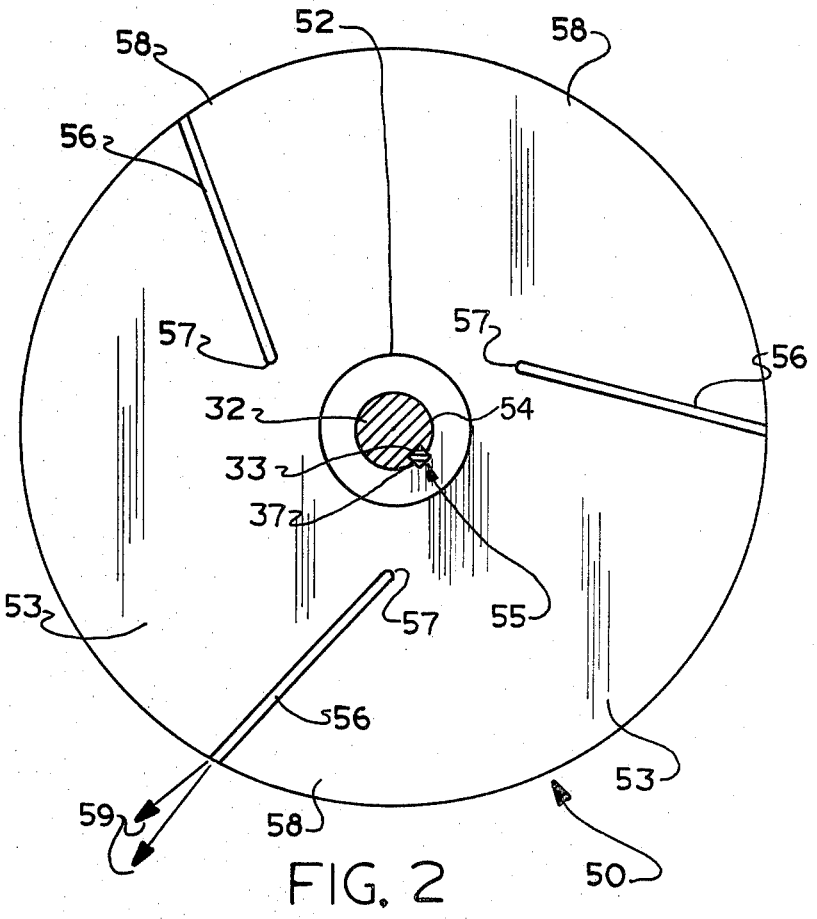
FIG. 2 is a side plan view of a rotating disc indicating the placement of fluid induction grooves in the radial surfaces of the disc.

The apparatus for inducing the circulation of the heating fluid 28 relies upon shafts 32, 35 and 36 for their support and movement. A plurality of rotating compression discs 50 are rotatable and slidably secured to key 33 in keyway recess 33 of rotatable shaft 32. Each rotating compression disc 50, as seen in FIG. 2, is composed of an axially extended hub 52 having on the inner bore 54 a keyway slot 55 to mate with key 37 in recess 33 of rotatable shaft 32. On the radial surfaces 53 of each rotating compression disc 50, are a plurality of fluid induction grooves 56 extending from the outer perimeter 58 of each plate 50. Each fluid induction groove 56 has a terminus 57 adjacent to but deflected at an angle from the axially extended hub 52 and inner bore 54 of disc 50. The angle of deflection, generally referred to as 59, may be perceived by an extension of the line of fluid induction groove 56 in comparison with a radial line extending from the axis of disc 50 from inner bore 54. As seen in FIG. 2, this deflection angle 59 is approximately 0° to 60°. Preferably, the angle is in the range from 10° to 35°. The dimensions and characteristics of the fluid induction grooves 56 on the radial surface 53 are duplicated on the obverse side of each rotating compression disc 50.

Figure 3:
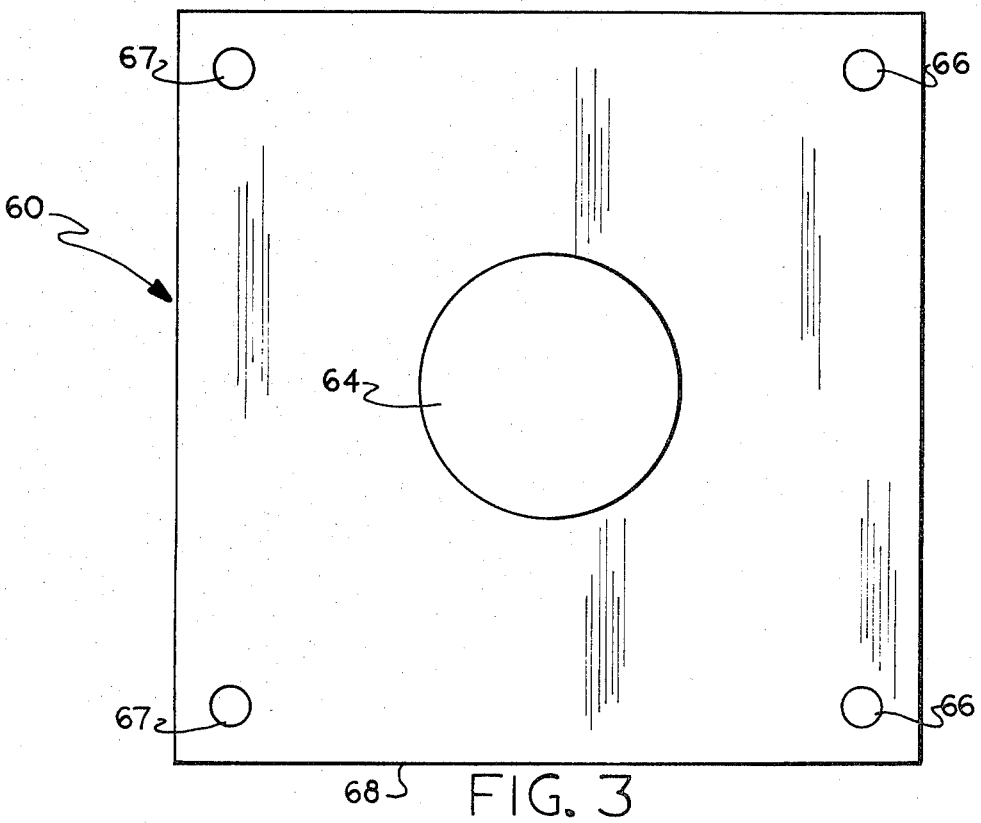
FIG. 3 is a side plan view of a stationary plate.

Each rotating compression disc 50 is sandwiched between two stationary compression plates 60 either circular or polygonal in shape. These compression plates, as seen in FIG. 3, have an enlarged inner bore 64 to permit free rotation of the extended hub 52 of rotating plate 50 on shaft 32. Each stationary compression plate 60 is secured at its outer perimeter 68 or corners to the stationary shafts 35 and 36. A pair of upper outer perimeter bores 66 permit slidable engagement of each stationary compression plate 60 on the upper stationary shaft 35. In a like manner, the lower outer perimeter bores 67 permit slidable engagement of the stationary compression plates 60 with the lower stationary shaft 36. Further each of the plates 60 has a deflection plate 69 appropriately secured to parallel outer perimeters 68 to assist in the fluid flow during generation of heat, only one such deflection plate 69 being shown in FIG. 1 for illustrative purposes.

Each rotating compression disc 50 and each stationary compression plate 60 are made from metallic materials known to those skilled in the art for providing lightweight but sturdy use. It has been found alloys of steel have provided sufficient longevity of operation for the stationary compression plate 60, whereas a lighter metal or metallic alloy such as aluminum or alloys containing aluminum are preferred for the rotating compression discs 50.

The slidable engagement of the stationary compression plates 60 along the upper stationary shaft and the slidable engagement of keyway slot 55 of rotating compression plate 50 with key 37 in keyway recess 33 of rotatable shaft 32 permit the compression of each sandwich conglomeration of rotating compression disc 50 interspaced between two stationary compression plates 60. The compression of discs 50 and plates 60 are controlled by the presence of tension means 38, as described above, surrounding upper and lower stationary shafts 35 and 36.

Because the space between each rotating compression disc 50 and its companion stationary compression plates 60 is crucial for the generation of heat through frictional passage of the heating fluid 28, a continuing compression pressure means is necessary for control of that friction producing space. The compression pressure means 40 exists by the combination of a pressure adjustment means 41 connected to an upper extension arm 43. At an upper pivot point 47, the upper extension arm 43 is connected with a pressure arm 42 extending towards the rotatable shaft 32, avoiding contact with stationary shafts 35 and 36. A brace 46 restrains the pressure arm 42 but is the subject of a middle pivot point 48 allowing movement of the pressure arm 42 relative to brace 46. At a lower pivot point 49, the pressure arm 42 is connected with a pressure ring 44. By the adjustment on pressure adjustment means 41, and through interconnection of arms 43 and 42 pivoting about pivot points 47, 48 and 49, the pressure ring 44 may engage the adjacent stationary compression plate 60, and through tension means 38, obtain a desired pressure compression on all compression plates 60. Pressure ring 44 is mounted surrounding rotatable shaft 32 without engagement or contact therewith. Therefore, pressure ring 44 engages a stationary compression plate 60 which adjusts the position of all plates 60 relative to rotating compression disc 50 adjacent thereto.

An understanding of the process for the production of heat may be understood by again referring to FIG. 1. The relative positions of the stationary compression plates 60 with respect to each rotary rotating compression disc 50 interspaced thereinbetween is crucial to the amount of heat generated by the induction of heating fluid 28 between discs 50 and plates 60. In order to initiate the induction of heating fluid 28 into fluid induction grooves 56 of rotating compression plates 50, no tension or pressure is applied by pressure means 40 against plates 60. However, after discs are rotating on shaft 32 and fluid 28 is circulating a pressure of from about 90 to about 190 lbs., as restrained by tension means 38, is applied by pressure ring 44 against stationary compression plate 60. Initiation of this tensional compression as restrained by tension means 38 places discs 50 and plates 60 in sufficient proximal relationship to initiate the heating of fluid 28 by frictional passage of fluid 28 between discs 50 and plates 60. Plates 60 and discs 50 may be from about 0.001 to about 0.010 inches for frictional passage of fluid 28. Indeed, plates 60 and discs 50 may be as proximal as a film of fluid 28 passing along radial surfaces 53.

Discs 50 rotate on shaft 32, powered by circulation means 30, within the sandwich of two stationary compression plates 60. The rotating compression discs 50 having fluid induction grooves 56 located at the outer perimeter 58 of each disc 50 induce the heating fluid 28 into the space of each fluid induction groove 56. As each rotating compression plate rotates on rotatable shaft 32, the fluid is subjected to centripetal forces and leaves the fluid induction grooves 56 between outer perimeter 58 and terminus 57 and spread along the radial surfaces 53 of compression plate 50. This frictional escape of heating fluid 28 along radial surfaces 53 is precipitated by the further induction of heating fluid 28 into the fluid induction grooves 56 by the continued rotation of the rotating compression discs 50 within plates 60 subjected to pressure of means 40 as restrained by means 28. Such a tensional relationship permits a fine adjustment of the space between discs 50 and plates 60, thereby controlling the amount of frictional heat generated during the pressured flow of fluid 28. Also, as the heating fluid 28 escapes and sprays from between discs 50 and plates 60, it has been found that deflection plate 69 controls the fluid to direct it against sidewalls 24 in a more concentrated volume. This improves heat transfer properties.

The evacuation of heating fluid 28 along the radial surfaces 53 occurs under the frictional engagement of the heating fluid 28 with adjacent stationary compression plates 60. It is a crux of the invention to prevent the engagement of rotating compression discs 50 with stationary compression plates 60 to prevent direct friction between those two components of the fluid friction assembly 20. Such a frictional contact of plates 50 and 60 would drain the energy from heating fluid circulation means 30 rather than adding energy thereto. Therefore discs 50 and plates 60 must be machined with a microfinish surface to prevent aberrations.

It is the forced evacuation of the heating fluid 28 from the fluid induction grooves 56 along radial surfaces 53 of rotating compression disc 50 and between discs 50 and plates 60 that provides the frictional heating process for the fluid 28 which, at rest as seen in FIG. 1, reaches a level just below hub 52 of discs 50. This heated fluid 28 forcefully sprays the sidewalls 24, as restricted by deflection plate 69, transferring the heat to the sidewalls 24. The fluid falls to the bottom of chamber 22 and is recirculated by the same process. By this conduction from fluid 28 to sidewalls 24 the heat chamber 22, made from suitable heat transfer materials familiar to those skilled in the art and optionally having fins, transfers the heat generated to the distributing fluid jacket 12, heating the distributing fluid 12. This distributing fluid 12 is circulated by pump 14 into the desired remote locations.

The performance of fluid friction furnace 10 conceived and disclosed herein indicates its unexpected energy efficiency.

A fluid friction furnace 10 having the components described hereinabove and having a 3 H.P. electric motor having the specifications preferred above, was initiated and operated according to the processes so indicated above. Utilizing an amperage of about 14 amperes at 110–120 volts, this fluid friction furnace 10 heated fourty gallons of water 49 degrees Fahrenheit to produce 16,268 British Thermal Units of heat in one hour to be transferred through the distributing fluid jacket 21 to the remote locations. Therefore the furnace 10 produced 9,683 BTU/kW in one hour. In comparison, utilizing an electric immersion device, forty gallons of water were heated 38 degrees Fahrenheit in one hour to produce 12,616 British Thermal Units. The electric immersion device required 17 amperes at 110–120 volts. Therefore, the electric immersion device produced 6,184 BTU/kW in one hour. The furnace 10 represents an improvement of existing heating apparatus which uses electricity as its source of energy. This is a significant advancement for areas where it is economically unsatisfactory to use a fossil fuel furnace.

While in accordance with the patent statutes, the best mode and preferred embodiment of the fluid friction furnace 10 has been disclosed, it is to be understood that the invention is not to be limited thereto or thereby. Consequently, for an understanding of the full and complete scope of the invention, reference is had to the following claims.

What is claimed is:

1. An apparatus for the generation of heat, comprising:

(a) an enclosed container assembly having side walls;

(b) a rotatable shaft mounted through said side walls of said container assembly;

(c) an upper stationary shaft and a lower stationary shaft extending within said container assembly between two said side walls;

(d) a plurality of stationary plates having a recess about said rotatable shaft and slidably engaged to both said stationary shafts;

(e) a plurality of rotating discs having radial surfaces and interspaced in proximity to said stationary plates, each said rotating disc slidably engaged to and rotatable with said rotatable shaft and having a plurality of fluid induction grooves on said radial surfaces;

(f) pressure means for placing said stationary plates near to said rotating discs, both said stationary shafts having tension means for restraining said slidable engagement of said stationary plates on both said stationary shafts;

(g) a volume of heat transfer fluid in communication with the lower extremities of said stationary plates and said rotating discs and inducible into said fluid induction grooves of said rotating discs and from said grooves in frictional, pressured communication between said discs and said plates, and wherein each said disc is separated from adjacent said plates at a distance from about 0.001 to about 0.010 inch; and (h) a deflection plate mounted on the outer perimeter of all said stationary plates.

2. An apparatus for the generation of heat, according to claim 1, wherein said apparatus further comprises means for circulation of said heat transfer fluid through rotation of said rotatable shaft.

3. An apparatus for the generation of heat, according to claim 1, wherein said heat transfer fluid contacts the lower extremities of said stationary plates and said rotating discs.

4. An apparatus for the generation of heat, according to claim 1, wherein fluid induction grooves extend at an angle from about 0 degrees to about 60 degrees relative to a radial line extending from the axis of each said disc.

5. An apparatus for the generation of heat, according to claim 1, wherein said discs are made from aluminum alloy and said plates are made from steel.

6. A method for the production of heat, comprising:

(a) tensionally placing a plurality of rotating discs within 0.001 to about 0.010 inch to a plurality of stationary plates interspaced therewith, each said stationary plate having a deflection plate mounted on the outer perimeter thereof, each said rotating disc having radial surfaces and slidably secured to a rotating shaft rotatably secured to an enclosed container, and each said rotating disc having a plurality of fluid induction grooves on said radial surfaces;

(b) rotating said shaft and all said rotating discs, the lower extremities of said rotating discs in a pool of heat transfer fluid in said enclosed container;

(c) inducing said heat transfer fluid into said fluid induction grooves in said rotating discs tensionally proximal with said stationary plates;

(d) forcing said fluid from between said rotating discs and said stationary plates along said radial surfaces in a pressured, frictional manner during said rotation of said rotating discs; and (e) transferring the heat from said heat transfer fluid to said container.

7. A method for the production of heat, according to claim 6, wherein said tensional compression comprises from about 90 to about 190 pounds per square inch of pressure.

8. A method for the production of heat, according to claim 6, wherein said forcing along said radial surfaces generates heat of friction in said heat transfer fluid.

9. A method for the production of heat, according to claim 6, wherein said transferring comprises spraying said fluid against side-walls of said container.

10. An apparatus for generating heat, comprising:

(a) at least two stationary plates;

(b) at least one rotating disc in close axial proximity to two said stationary plates; and (c) a volume of heat transfer fluid, each said rotating disc having means for inducing said fluid between said rotating disc and said stationary plates, said rotating discs and stationary plates being spaced apart by said fluid.

* * * * *